US007556069B2

(12) United States Patent
Chuang

(10) Patent No.: US 7,556,069 B2
(45) Date of Patent: Jul. 7, 2009

(54) ADJUSTING DEVICE FOR THE CONVEYING BELT OF A PLANER

(76) Inventor: Bor-Yann Chuang, No. 78, Yungfeng Rd., Taiping City, Taichung (TW) 411

( * ) Notice: Subject to any disclaimer, the term of this patent is extended or adjusted under 35 U.S.C. 154(b) by 337 days.

(21) Appl. No.: 11/580,293

(22) Filed: Oct. 13, 2006

(65) Prior Publication Data

US 2008/0087355 A1 Apr. 17, 2008

(51) Int. Cl.
*B27C 1/00* (2006.01)
*B27B 31/00* (2006.01)

(52) U.S. Cl. ..... 144/114.1; 144/117.1; 144/245.1; 409/161; 409/173; 198/816

(58) Field of Classification Search ..... 144/114.1, 144/117.1, 129, 130, 245.1, 245.2; 409/145, 409/162, 159, 161, 172, 173; 198/813, 816
See application file for complete search history.

(56) References Cited

U.S. PATENT DOCUMENTS 4,997,017 A * 3/1991 Dobbie ..... 144/128
5,626,447 A * 5/1997 Buysman et al. ..... 409/139
5,882,157 A * 3/1999 Buysman et al. ..... 409/139
5,979,520 A * 11/1999 Behrendt ..... 144/114.1
6,405,769 B1 * 6/2002 Labrie ..... 144/3.1
7,252,124 B1 * 8/2007 Chuang ..... 144/117.1

FOREIGN PATENT DOCUMENTS

GB 2041315 A * 9/1980

* cited by examiner

*Primary Examiner*—Shelley Self
(74) *Attorney, Agent, or Firm*—Ming Chow; Sinorica, LLC

(57) ABSTRACT

An adjusting device for the conveying belt of a planer includes a fundamental plate assembled on the base of a planer. The fundamental plate has its rear end disposed with a rear roller unit connected with the base of the planer and composed of two adjusting plates and a rear roller. The two adjusting plates are respectively bored with longitudinal insert slots preset in number to enable the adjusting plates to be slidably assembled on the fundamental plate. Each adjusting plate has its front end extending outward vertically and forming a positioning wall pivotally fixed thereon with a positioning member and movably fastened on the base of the planer. The adjusting device for the conveying belt of this invention is simple in structure and easy to be assembled, lowering processing and assembling cost.

4 Claims, 8 Drawing Sheets

ADJUSTING DEVICE FOR THE CONVEYING BELT OF A PLANER

BACKGROUND OF THE INVENTION

1. Field of the Invention

This invention relates to an adjusting device for the conveying belt of a planer, particularly to one provided with a rear roller unit composed of two adjusting plates and a rear roller, simple in structure and able to quickly adjust the tightness of the conveying belt of a planer.

2. Description of the Prior Art

A conventional planer is provided with a conveying device 10 on its base 1 for conveying and feeding a work piece, as shown in FIG. 1. The conveying device 10 is composed of a conveying belt 11 for conveying the work piece and an adjusting roller 12 for adjusting the tightness of the conveying belt 11. The adjusting roller 12 has its opposite ends respectively fixed with an adjusting threaded rod 121 and its central portion fixed with a slide rod 122 respectively extending outward vertically. The base 1 of the planer has its opposite ends of one side respectively bored with an adjusting hole 13 for the adjusting threaded rod 121 to be screwed therein and has its central portion bored with a slide hole 14 for receiving the slide rod 122 therein. Thus, the adjusting roller 12 can be slidably assembled on the base 1 and the tightness of the conveying belt 11 can be properly adjusted by adjusting the position of the adjusting threaded rods 121 in the adjusting holes 13.

However, the adjusting roller 12 of the conveying device 10 of the conventional planer must be provided with the adjusting threaded rods 121 and the slide rod 122 in order to enable the adjusting roller 12 to be slidably assembled on the base 1 of the planer, thus complicating the structure and increasing difficulty in assembly. In addition, the base 1 of the planer must be bored with the adjusting holes 13 and the slide hole 14 respectively for receiving the adjusting threaded rods 121 and the slide rod 122 of the adjusting device 10, thus increasing processing cost.

SUMMARY OF THE INVENTION

The objective of the invention is to offer an adjusting device for the conveying belt of a planer, and the device includes a fundamental plate, a front roller unit, a rear roller unit and a conveying belt. The fundamental plate is assembled on the fundamental base of a planer, and the front and the rear roller unit are respectively disposed at the front and the rear end of the fundamental plate. The front roller unit secured at the front end of the fundamental plate has one side fixed with an input shaft connected with a power source. The rear roller unit is composed of two adjusting plates and a rear roller. The two adjusting plates are respectively bored with longitudinal insert slots preset in number for slidably assembling the adjusting plates along the fundamental plate. Further, the two adjusting plates have their front ends respectively extending outward vertically and forming a positioning wall pivotally fixed thereon with a positioning member pushing against the opposite sides of the fundamental and able to move back and forth axially. The conveying belt is mounted around the fundamental plate, the front roller unit and the rear roller unit. The adjusting device for the conveying belt of a planer in the present invention is simple in structure, easy to be assembled and convenient to adjust the tightness of the conveying belt, facilitating maintenance and adjustment and heightening market competitive capability.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
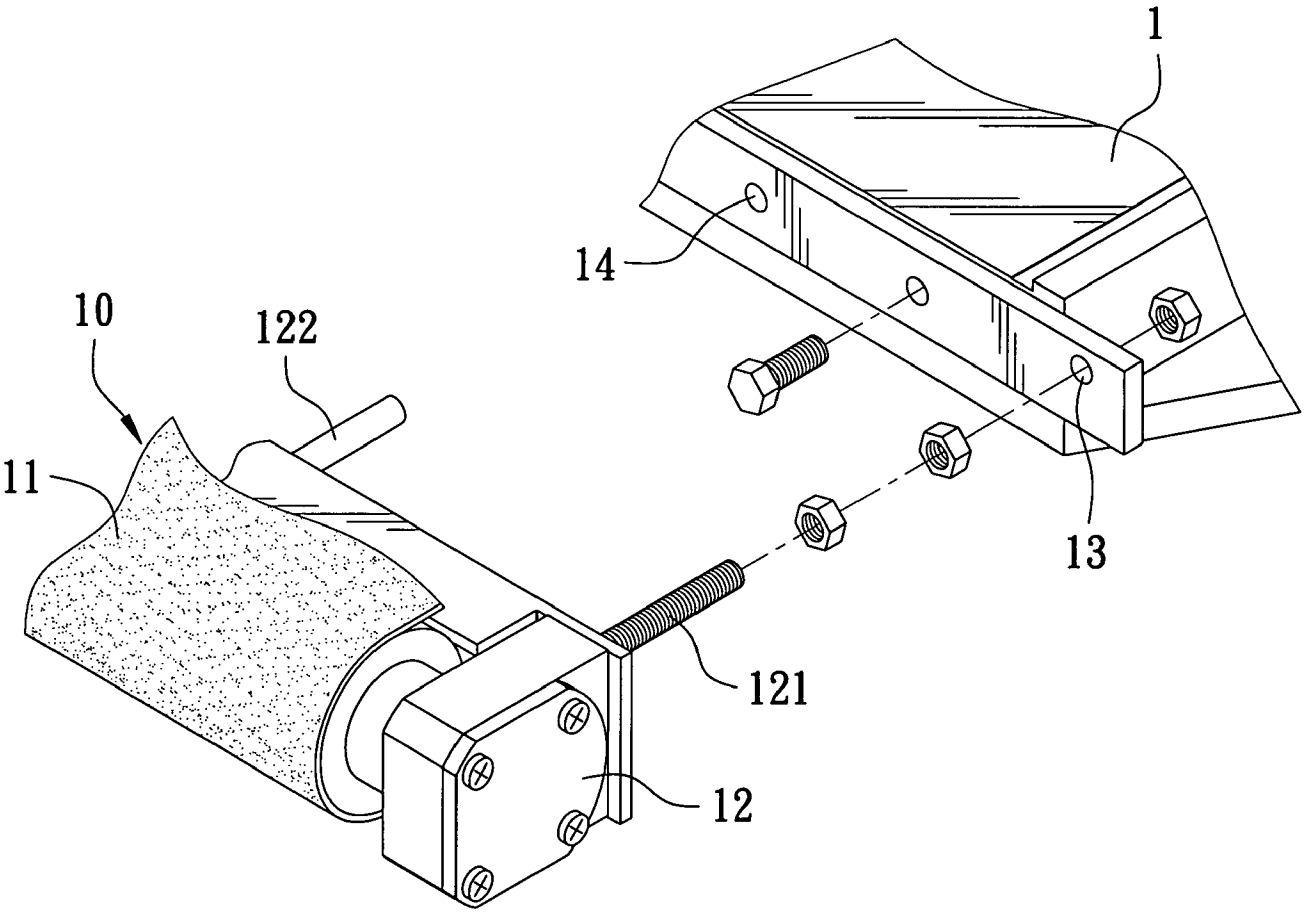
FIG. 1 PRIOR ART
FIG. 1 is a partial exploded perspective view of the conveying device of a conventional planer.
Figure 2:
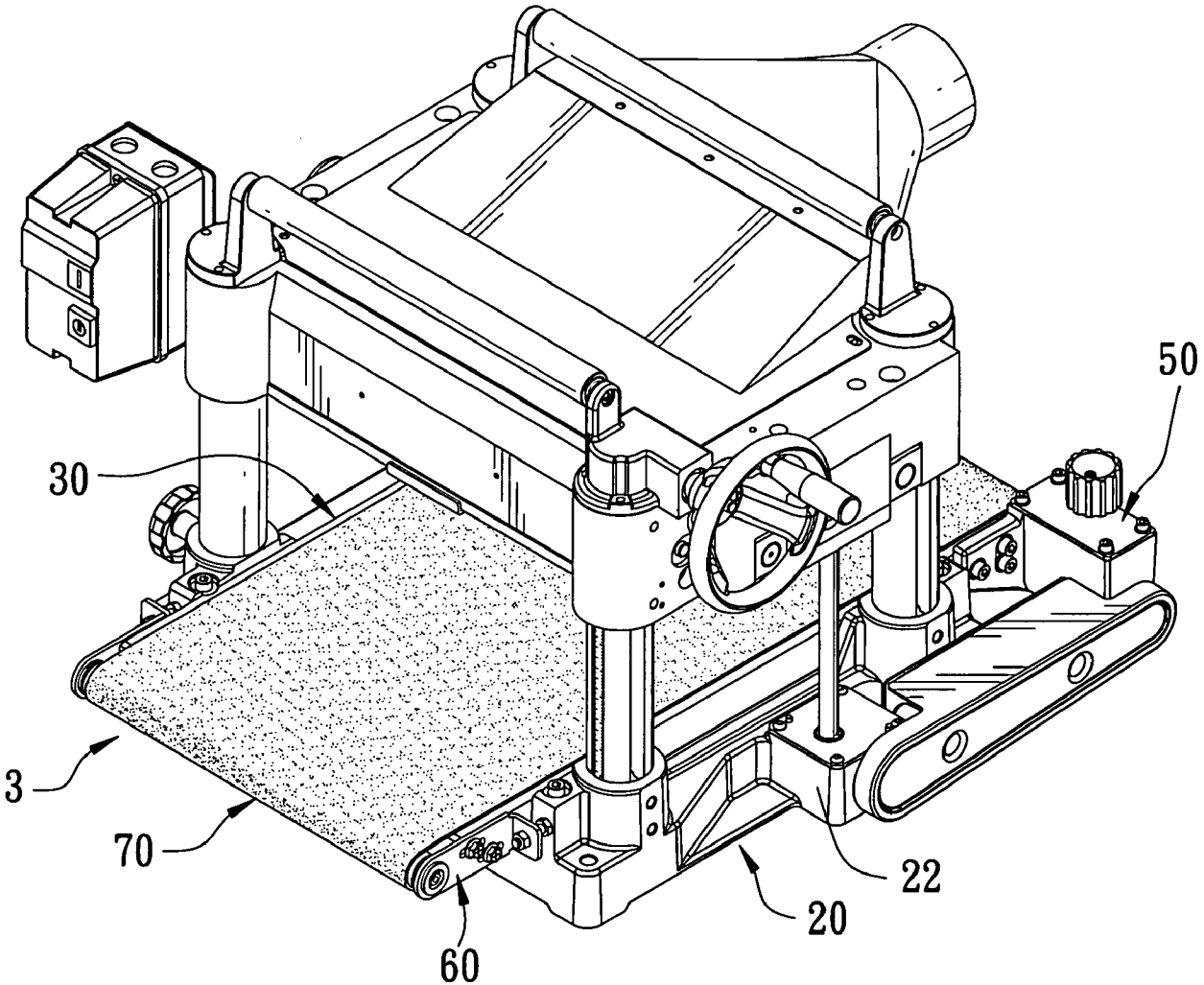
FIG. 2 is a perspective view of an adjusting device for the conveying belt of a planer in the present invention.
Figure 3:
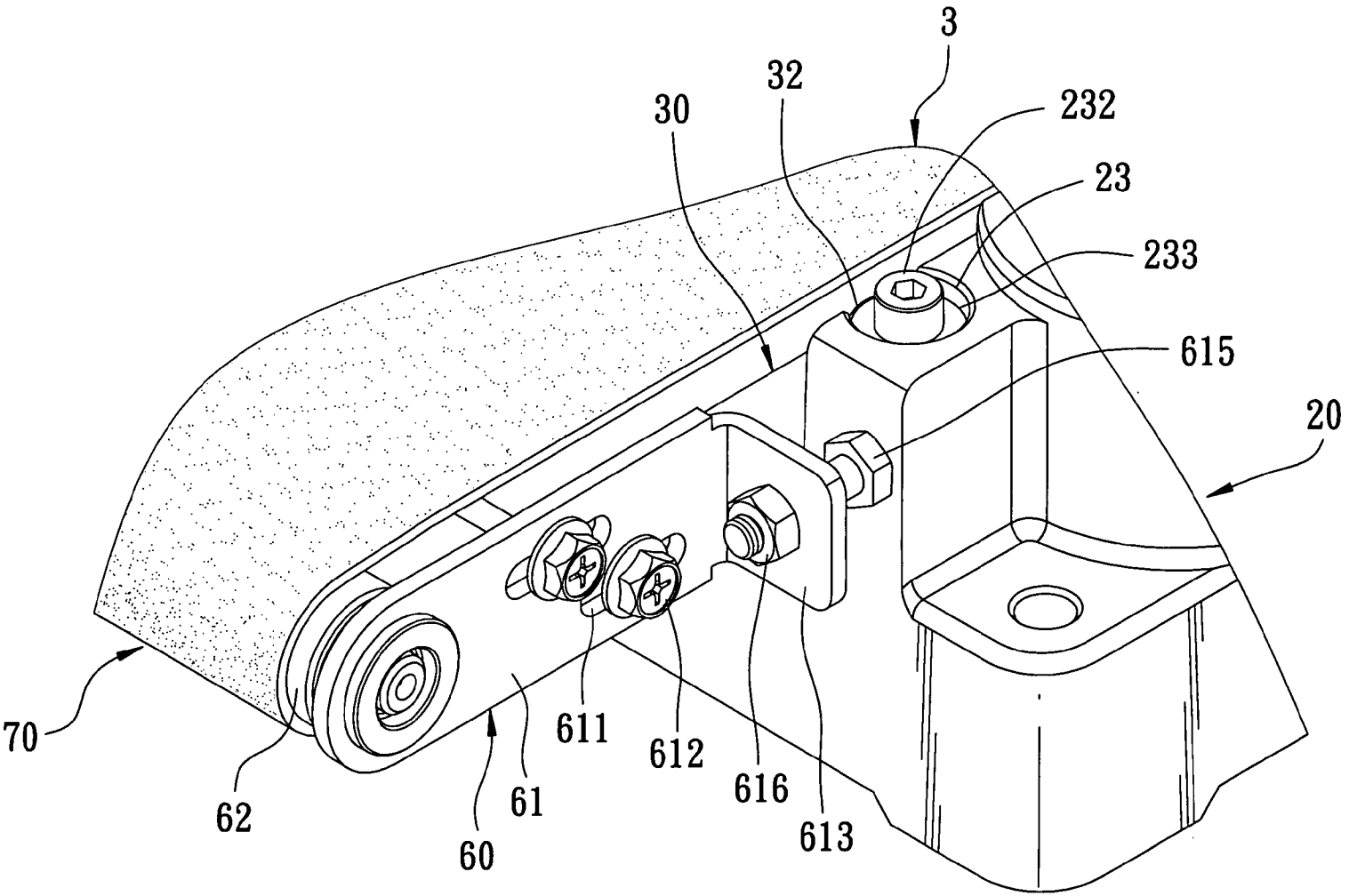
FIG. 3 is a partial perspective view of the adjusting device for the conveying belt of a planer in the present invention.
Figure 4:
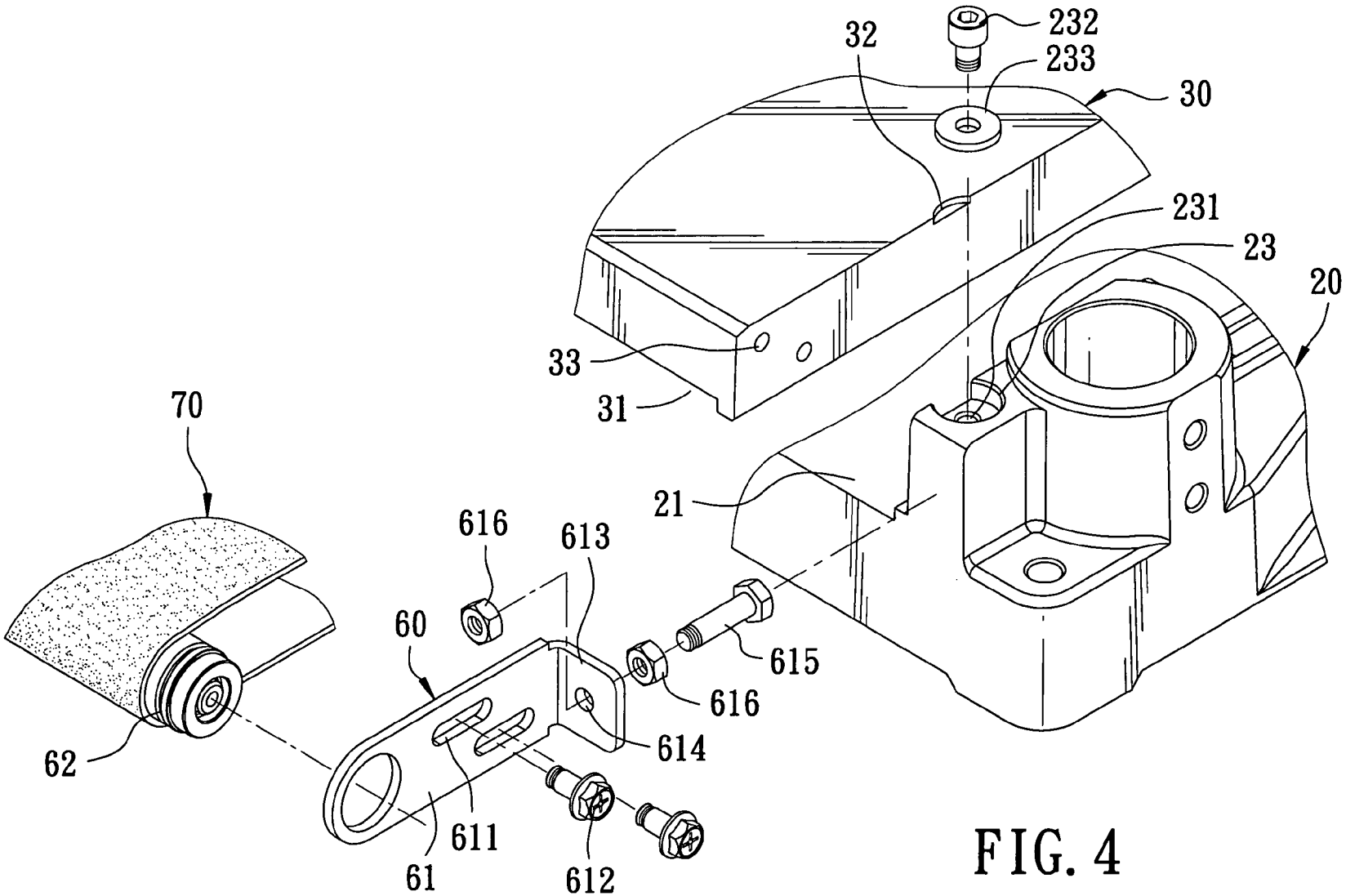
FIG. 4 is a partial exploded perspective view of the adjusting device for the conveying belt of a planer in the present invention.
Figure 5:
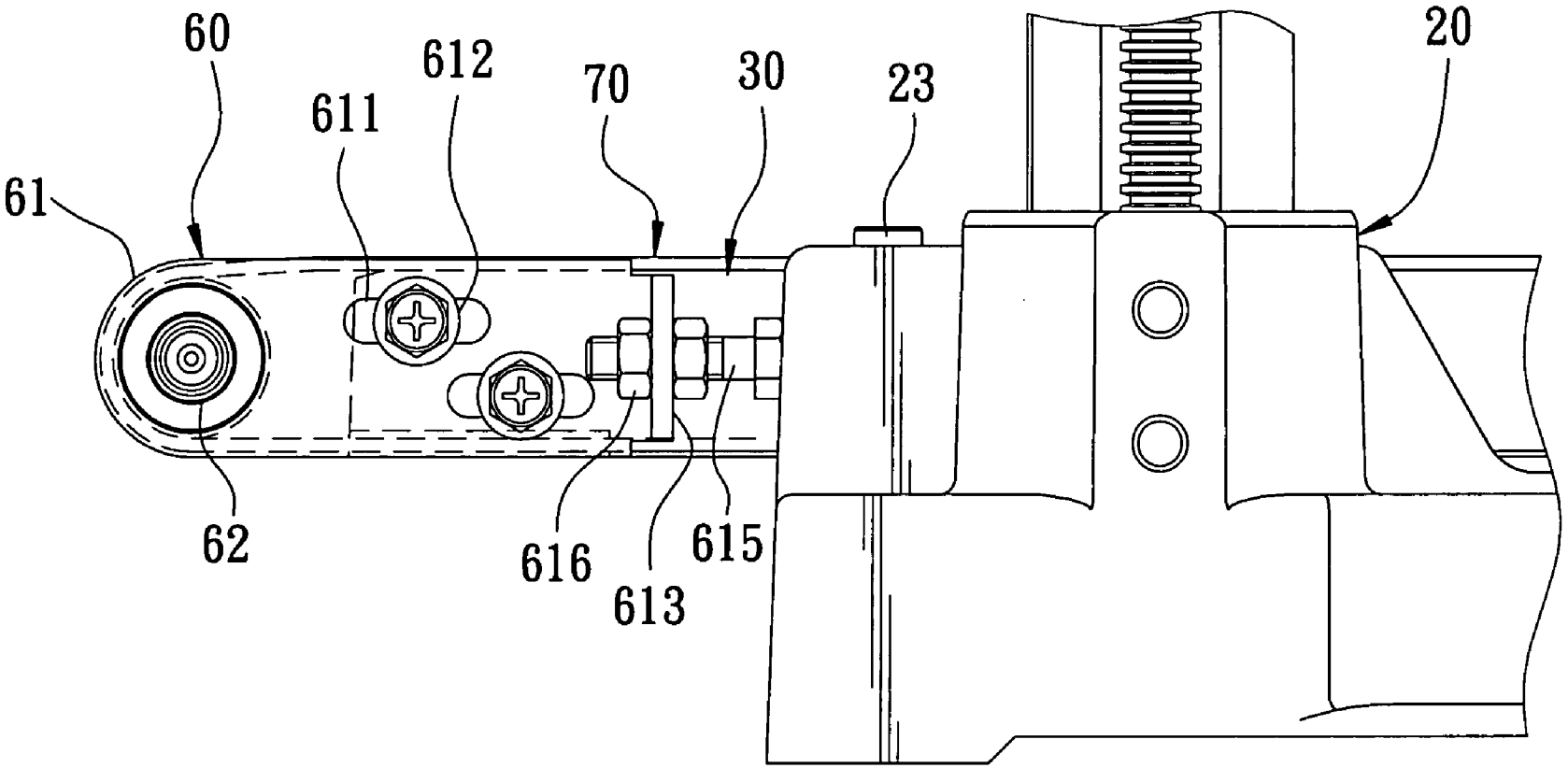
FIG. 5 is a side cross-sectional view of the adjusting device in an adjusted condition in the present invention.
Figure 6:
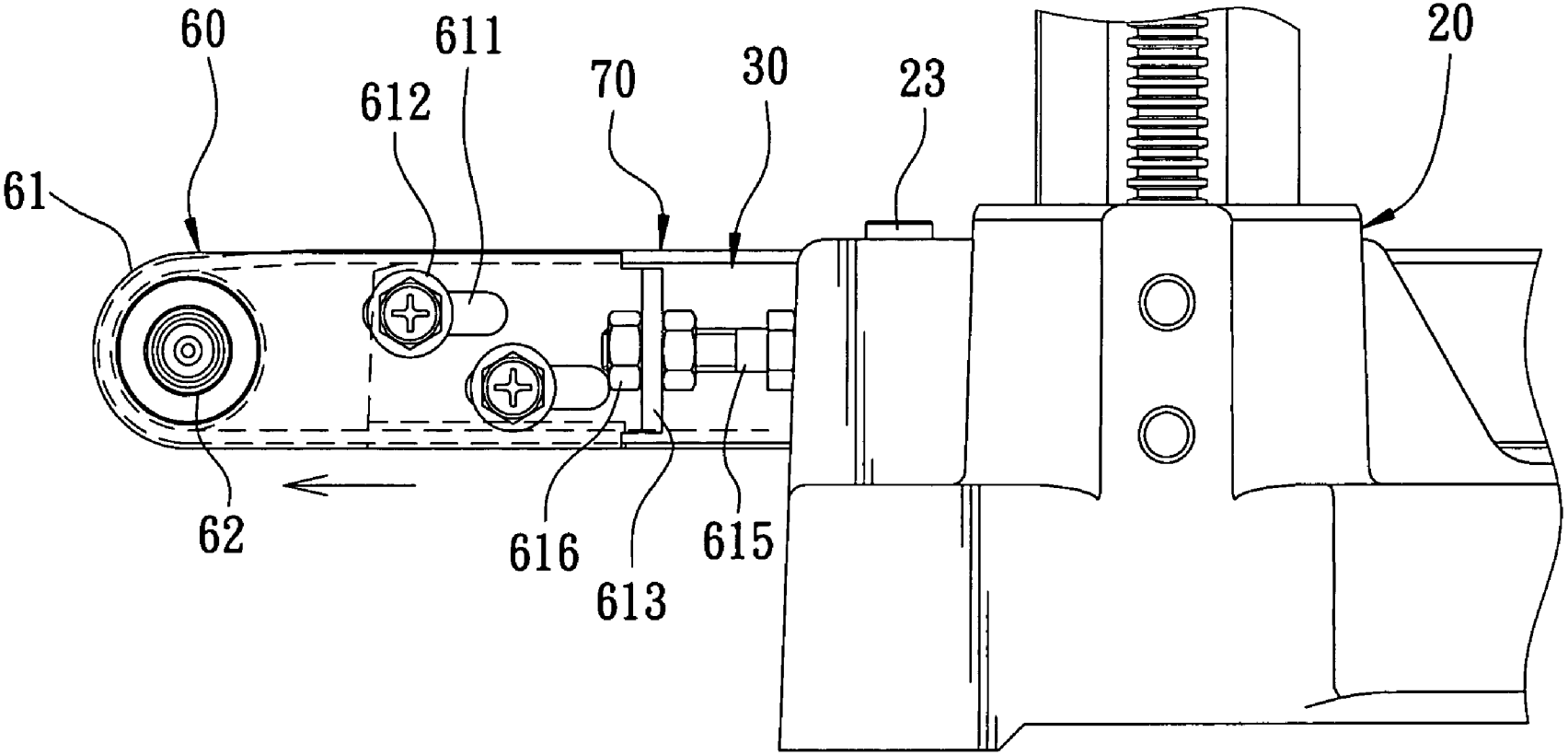
FIG. 6 is a side cross-sectional view of the adjusting device in another adjusted condition in the present invention.

A preferred embodiment of an adjusting device for the conveying belt of a planer in the present invention, as shown in FIGS. 2-8, includes a fundamental base 20 and a conveying device 3.

The fundamental base 20 has its topside formed with a recess 21 for receiving the conveying device 3 and one side secured with a power source 22 having its outer side disposed with a chain wheel 221 connected with the conveying device 3 by a chain 222. The fundamental base 20 further has its topside bored with four arc-shaped position-limiting grooves 23 positioned at the periphery of the recess 21 and respectively formed with an open end facing the recess 21. Each arc-shaped position-limiting groove 23 has its bottom bored with a threaded hole 231 to be screwed with a bolt 232 fitted thereon with a positioning block 233.

The conveying device 3 consists of a fundamental plate 30, a front roller unit 40, a speed-change gear unit 50, a rear roller unit 60 and an endless conveying belt 70.

The fundamental plate 30 received in the recess 21 of the fundamental base 20 of the planer is formed with an accommodating space 31 between its underside and the recess 21 of the fundamental base 20 for the conveying belt 70 to be inserted therethrough. Further, the fundamental plate 30 has its upper periphery formed with four position-limiting grooves 32 to be respectively coincided with the four arc-shaped position-limiting grooves 23 of the fundamental base 20 and positioned on the fundamental base 20 by the positioning block 233. Furthermore, the fundamental base 30 has the ends of its opposite sides respectively bored with two threaded holes 33.

The front roller unit 40 is secured at the front end of fundamental plate 30 by two fixing plates 41 having their front end pivotally disposed with a front roller 42. The front roller 42 is provided with an input shaft 421 extending outward from one side facing to a power source 22 to be connected with the speed-change gear unit 50.

The speed-change gear unit 50 is composed of an input gear unit 51 and a transmission gear shaft 52. The input gear unit 51 is pivotally fitted on the input shaft 421 of the front roller 42 and composed of a high-speed gear 511 and a low-speed gear 512. The input gear unit 51 has its central portion pivotally connected with an eccentric shaft 513, which is pivotally combined with the speed-change gear unit 50. When rotated, the eccentric shaft 513 will have its end actuating the input gear unit 51 to move back and forth axially on the input shaft 421. The transmission gear shaft 52 has its outer end fixed with a transmission chain wheel 521 connected with the chain 222 of the power source 22. Further, the transmission gear shaft 522 is fixed thereon with a low-speed transmission gear 522 and a high-speed transmission gear 523 respectively to be engaged with the low-speed gear 512 and the high-speed gear 511 of the input gear unit 51 for rotating together.

The rear roller unit 60 consists of two adjusting plates 61 and a rear roller 62. The two adjusting plates 61 are respectively bored with two longitudinal insert slots 611 for two bolts 612 to be respectively insert therethrough and then screwed with the threaded holes 33 of the fundamental plate 30 to enable the two adjusting plates 61 to slide back and forth along the fundamental plate 30. Each adjusting plate 61 has its front end extending outward vertically and forming a positioning wall 613 with a positioning hole 614 bored in the center for a positioning member 615 to be pivotally inserted therethrough. After inserted through the positioning portion 613 of the adjusting plate 61, the positioning member 615 made of a threaded rod has its two ends at the opposite sides of the positioning wall 613 respectively screwed with a nut 616. The rear roller 62 is pivotally assembled at the rear end of the two adjusting plates 61.

The endless conveying belt 70 is mounted around the fundamental plate 30 and the front roller 42 as well as the rear roller 62.

In assembling, as shown in FIGS. 3-6, firstly, the fundamental plate 30 is received in the recess 21 of the fundamental base 20 of the planer and the conveying belt 70 is fitted around the fundamental plate 30, the front roller 42 and the rear roller 62. Next, unscrew the bolts 612 on the two adjusting plates 61 and the nut 616 on the positioning member 615 to enable the two adjusting plates 61 to be moved back and forth for a needed distance for adjusting the tightness of the conveying belt 70 and then make the positioning members 615 on the two adjusting plates 61 fastened on the fundamental base 20 of the planer.

Figure 7:
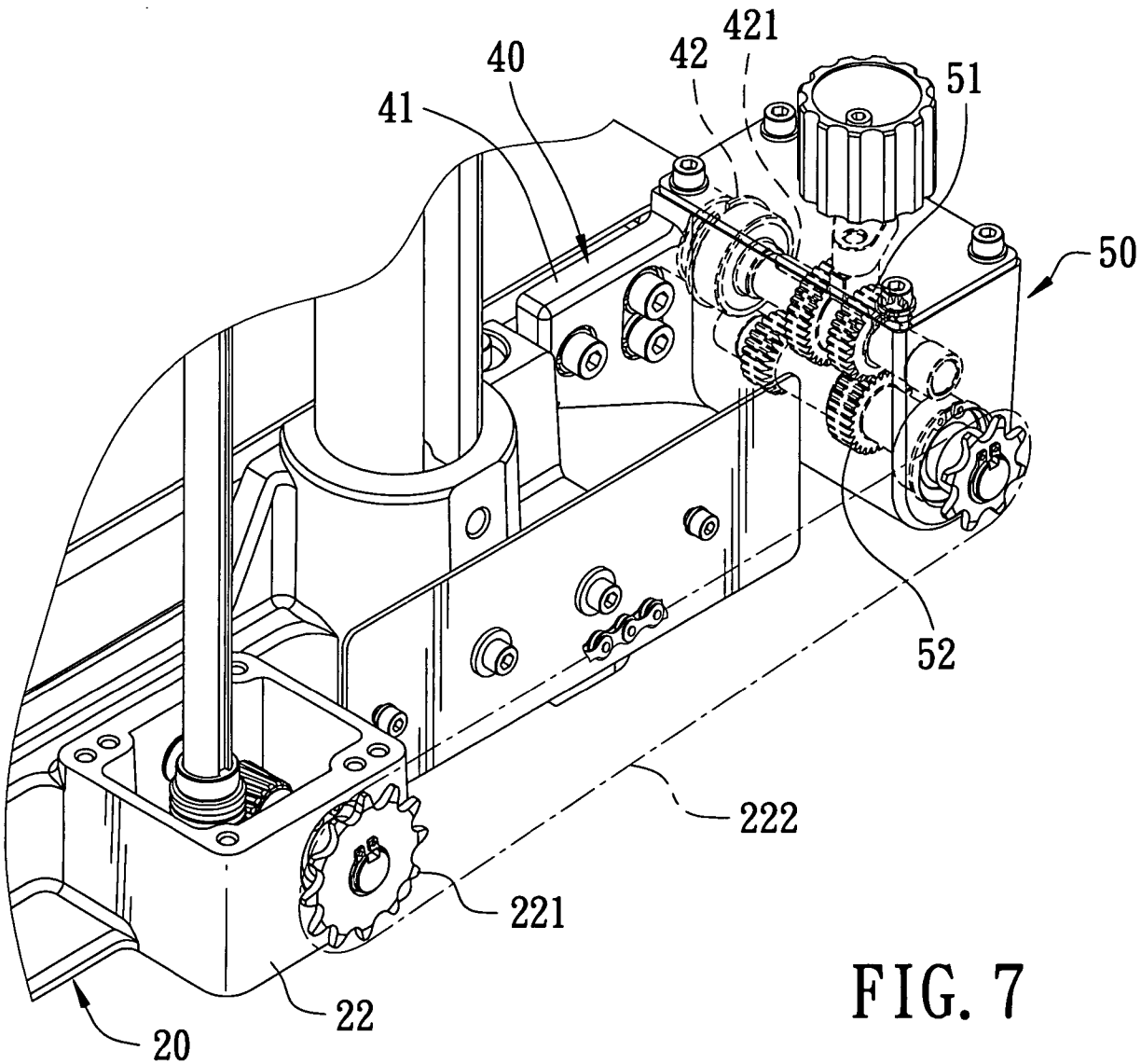
FIG. 7 is a perspective view of the transmission mechanism of the adjusting device in the present invention.
Figure 8:
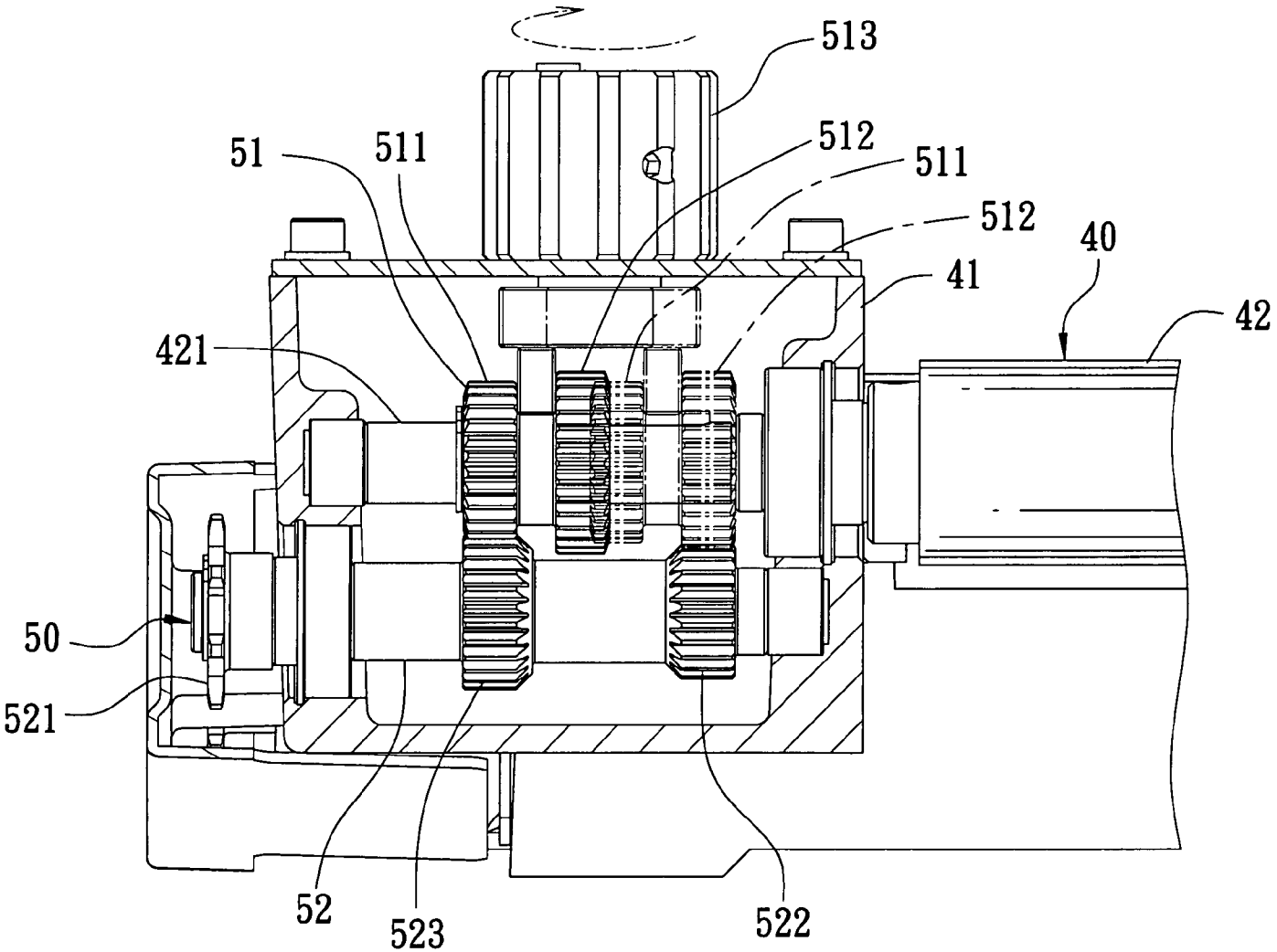
FIG. 8 is a cross-sectional view of the speed-change unit of the adjusting device in the present invention.

Referring to FIGS. 7 and 8, when the planer is started to operate, the power source 22 will drive the chain 222 of the power source 22 to rotate and actuate the transmission chain wheel 521 of the speed-change gear unit 50 to rotate. Simultaneously, the high-speed gear 511 or the low-speed gear 512 of the input gear unit 51 will be actuated by the eccentric shaft 513 to engage with the high-speed transmission gear 523 or the low-speed transmission gear 522 of the transmission gear unit 52 for making the front roller 42 of the front roller unit 40 rotate at a high or a low speed to enable the conveying belt 70 to feed a work piece at the high or the low speed.

Evidently, the adjusting device for the conveying belt of a planer has the two adjusting plates of its rear roller unit pivotally combined with the fundamental base of the planer and with the positioning member of the fundamental base for adjusting the tightness of the conveying belt, simple in structure, easy to adjust the conveying belt and convenient in handling, and able to lower producing cost and elevate competitive force in the market.

While the preferred embodiment of the invention has been described above, it will be recognized and understood that various modifications may be made therein and the appended claims are intended to cover all such modifications that may fall within the spirit and scope of the invention.

I claim:

1. An adjusting device for the conveying belt of a planer comprising, a fundamental base;

a conveying device:

said fundamental base having a topside formed with a recess for receiving said conveying device;

said fundamental base having one side fixed with a power source at a location;

said power source being connected with said conveying device:

said conveying device being composed of a fundamental plate, a front roller unit, a rear roller unit, and a conveying belt:

said fundamental plate being pivotally received in said recess of said fundamental base;

an accommodating space being formed between an underside of said fundamental plate and said recess of said fundamental base wherein said conveying belt being inserted therethrough:

said front roller unit being secured at a front end of said fundamental plate by two fixing plates;

said two fixing plates having a front ends pivotally assembled with a front roller;

said front roller having one end disposed with an input shaft connected with said power source;

said rear roller unit being composed of two adjusting plates and a rear roller, each of said adjusting plate being bored with longitudinal insert slots preset in number to enable said adjusting plate being slidably positioned on said fundamental plate;

each adjusting plate having a front end extending outward vertically and forming a positioning wall;

each of said positioning wall of said adjusting plate being pivotally combined with a positioning member;

each of said positioning member being fastened on an opposite side of said fundamental base of a planer;

said rear roller being pivotally assembled at rear ends of said two adjusting plates: and said conveying belt being mounted around said fundamental plate, said front roller, and said rear roller.

2. The adjusting device for the conveying belt of a planer as claimed in claim 1, wherein said fundamental base has a topside bored with a plurality of arc-shaped position-limiting grooves at locations of the opposite sides of said recess, each said arc-shaped position-limiting groove bored with a threaded hole at a bottom of said arc-shaped position-limiting groove, said fundamental plate bored with a plurality of position-limiting grooves to be coincided with said arc-shaped position-limiting grooves of said fundamental base, said arc-shaped position-limiting grooves respectively having a bolt to be screwed with said threaded hole at the bottom, said bolt fitted thereon with a positioning block for restrictedly fixing said arc-shaped position-limiting groove and said position-limiting groove.

3. The adjusting device for the conveying belt of a planer as claimed in claim 1, wherein said input shaft of said front roller connected with a speed-change gear unit, said speed-change gear unit composed of an input gear unit and a transmission gear shaft, said input gear unit pivotally assembled on said input shaft of said front roller, said input gear unit composed of a high-speed gear and a low-speed gear, said input gear unit having a central portion pivotally connected with an eccentric shaft, said eccentric shaft rotated eccentrically to actuate said input gear unit to move back and forth on said input shaft, said transmission gear shaft connected with said power source for rotating together, said transmission gear shaft fixed thereon with a low-speed transmission gear and a high-speed transmission gear to be driven and respectively engaged with said low-speed gear and high-speed gear of said input gear unit.

4. The adjusting device for the conveying belt of a planer as claimed in claim 1, wherein said positioning member is made of a threaded rod, and said positioning wall of said adjusting plate of said rear roller unit is bored with a positioning hole, said threaded rod inserted in said positioning hole of said positioning wall of said adjusting plate, said positioning member having two ends at the opposite sides of said positioning wall of said adjusting plate respectively screwed with a nut.

* * * * *